US008646888B2

(12) United States Patent
Gocho et al.

(10) Patent No.: US 8,646,888 B2
(45) **Date of Patent: *Feb. 11, 2014**

(54) CARTRIDGE AND PRINTING APPARATUS

(71) Applicant: Seiko Epson Corporation, Tokyo (JP)

(72) Inventors: Satoshi Gocho, Kitakatsushika-gun (JP); Atsushi Kijima, Kitakatsushika-gun (JP); Yoshihiro Koizumi, Shiojiri (JP); Yoshihiro Nakamura, Matsumoto (JP); Akihito Matsumoto, Chino (JP); Takeshi Iwamuro, Matsumoto (JP); Nobumasa Fukushima, Okaya (JP); Masaru Takahashi, Matsumoto (JP); Takakazu Fukano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/632,264

(22) Filed: Oct. 1, 2012

(65) Prior Publication Data

US 2013/0083141 A1 Apr. 4, 2013

(30) Foreign Application Priority Data

Sep. 29, 2011 (JP) ..... 2011-213878

(51) Int. Cl.
*B41J 2/175* (2006.01)

(52) U.S. Cl.
USPC ..... 347/86

(58) Field of Classification Search
USPC ..... 347/19, 85, 86, 87; 427/162, 163.1; 385/9, 130, 131
See application file for complete search history.

(56) References Cited

U.S. PATENT DOCUMENTS

| | | | | |
|---|---|---|---|---|
| 6,952,504 | B2 * | 10/2005 | Bi et al. | 385/9 |
| 7,656,084 | B2 * | 2/2010 | Ishida | 313/504 |
| 8,206,779 | B2 * | 6/2012 | Suzuki et al. | 427/162 |
| 2013/0083142 | A1 * | 4/2013 | Minamikawa et al. | 347/86 |

FOREIGN PATENT DOCUMENTS

JP 2005-119228 A 5/2005

* cited by examiner

*Primary Examiner* — Anh T. N. Vo
(74) *Attorney, Agent, or Firm* — Nutter McClennen & Fish LLP

(57) ABSTRACT

An ink cartridge has a label portion on a wall surface of one periphery of a case forming an ink accommodating unit. The label unit has a lamination structure in which a plurality of layers with different properties and states are laminated, and includes an optical functional layer that allows light (first wavelength of light) with a predetermined wavelength to pass and an optical reflective layer that reflects the first wavelength of light, and the optical reflective layer is a surface side of the case. When the optical reflective layer is heated from a thermal head of a heating unit directed to the label portion, the optical reflective layer irreversibly raises absorptivity of the first wavelength of light with respect to a received range.

10 Claims, 10 Drawing Sheets

CARTRIDGE AND PRINTING APPARATUS

Priority is claimed under 35 U.S.C. §119 to Japanese Application No. 2011-213878 filed on Sep. 29, 2011 which are hereby incorporated by reference in its entirety.

BACKGROUND

1. Technical Field

The present invention relates to a cartridge that accommodates a printing material used for printing, and a printing apparatus in which the cartridge is provided.

2. Related Art

When a cartridge is provided for use in a printing apparatus, various kinds of information are transmitted and received between the cartridge and the printing apparatus. Accordingly, a technique of providing the cartridge with a storage element is proposed (for example, JP-A-2005-119228). In the storage element, information for a printing material accommodated in the cartridge such as a remaining printing material amount is stored according to the color of the printing material, and different kinds of printing materials are prevented from being supplied on the basis of the information.

The technique disclosed in JP-A-2005-119228 is a technique corresponding to a demand for recording any information about the cartridge. However, it is necessary to provide the cartridge with a storage element such as an EEPROM, and it is necessary to provide electrical connection for communication between a storage element of the cartridge and a control circuit unit of a recording apparatus body, and thus a structure of the cartridge is complex.

SUMMARY

An advantage of some aspects of the invention is to provide a new method of coping with the update of information about a cartridge.

The invention can be realized in the following forms or application examples.

APPLICATION EXAMPLE 1

Cartridge

According to Application Example 1, there is provided a cartridge which accommodates a printing material used for printing, wherein an optical functional layer that allows a predetermined wavelength of light to pass, and an optical reflective layer that reflects the wavelength of light are laminated on a surface of the cartridge such that the optical reflective layer is the surface side of the cartridge, and wherein the optical reflective layer has a property and a state in which absorptivity of the wavelength of light is irreversibly raised by received heat.

The cartridge having the configuration can perform the update of information described hereinafter, by an optical functional layer and an optical reflective layer laminated and provided on the cartridge surface. Hereinafter, for convenience of description, the optical functional layer and the optical reflective layer laminated and provided on the cartridge surface as described above are called a lamination unit, and the update of information in the cartridge having the configuration will be described.

When the lamination unit receives heat, the heat acts on the optical reflective layer included in the lamination unit. In the optical reflective layer, absorptivity of the predetermined wavelength of light (hereinafter, referred to as "the first wavelength of light") of the optical reflective layer is irreversibly raised in the heat reception range that receives the heat. For this reason, in the lamination unit, before and after heat reception, the absorptivity of the optical reflective layer with respect to the first wavelength of light is different in the heat reception range. Specifically, when the lamination unit is irradiated with the first wavelength of light from the side of the optical functional layer, the state of reflection of the first wavelength of light from the optical reflective layer is different before and after the heat reception, from the difference of the absorptivity in the optical reflective layer. That is, the lamination unit is changed before and after the heat reception, and the change is irreversible since the change of the absorptivity in the optical reflective layer is irreversible. The irreversible change of the lamination unit corresponds to an electrical data update in the storage element, for example, an update of information in which data is updated from a value of 0 to a value of 1 or vice versa. Therefore, according to the cartridge having the configuration, it is possible to perform an update of information pertaining to the cartridge in the lamination unit provided on the cartridge surface. In this case, when the irreversible change of the lamination unit is caused, for example, in a cartridge in which the printing material is exhausted, and even when a cartridge is erroneously mounted, it is possible for a user to recognize the erroneous mounting. The irreversible change of the absorptivity in the optical reflective layer described above corresponds to an irreversible decrease of the reflectance with respect to the first wavelength of light. It corresponds to the update of information in the lamination unit of the cartridge surface, and it is not necessary to use the storage element, but it is possible to use the storage element together.

The cartridge described above may be formed in the following aspect. For example, an optical absorption pattern layer forming a pattern having a shape of occupying a part of the optical functional layer is provided by the material absorbing the wavelength of light, the optical absorption pattern layer may be provided on any of the front and rear surfaces of the optical function layer. In such a manner, for the first wavelength of light irradiated from the side of the optical functional layer to the lamination unit, the light is absorbed in the pattern of the optical absorptive pattern layer, the light quantity reaching the optical reflective layer is decreased, and the light reaches the optical reflective layer in parts other than the pattern. The light reaching the optical reflective layer is reflected by the influence of absorptivity in the optical reflective layer in the reaching portions. Accordingly, the pattern image of the optical absorptive pattern layer is projected by the reflection of the first wavelength of light, and thus the irreversible change of the lamination unit before and after the heat reception may be recognized as a change of the pattern image. As a result, according to the aspect, it is possible to more significantly recognize the irreversible change of the lamination unit by the pattern image change of the optical absorptive pattern layer.

Specifically, in the optical reflective layer after the heat reception, in a first part corresponding to the pattern of the optical absorptive pattern layer, the reflectivity of the first wavelength of light is further decreased as compared with the second part other than the pattern. The lamination unit displays the first pattern image of the pattern corresponding to the first part, and the reflectance of the first wavelength of light is decreased with respect to the part other than the pattern after the heat reception of the optical reflective layer. Accordingly, in the lamination unit, after the whole of the lamination unit is heated, when the first wavelength of light is irradiated, the first pattern image is displayed with a contrast lower than that before heating, or the first pattern image is not displayed, and it is possible to more significantly recognize the irreversible change of the lamination unit according to the change of the optical absorptive pattern layer. When the absorptivity of only a partial area of the lamination unit is irreversibly raised by receiving heat in advance, the influence of the change in absorptivity in the previous heat reception range is reflected to the first pattern image when the irradiation of the first wavelength of light is performed, and it becomes a second pattern image different from the first pattern image. Accordingly, even in this case, it is possible to more significantly recognize the irreversible change of the lamination unit due to the change of the pattern image of the optical absorptive pattern layer.

When the wavelength of light (the first wavelength of light) is irradiated, a combination of at least a part of the pattern, and the pattern of the part where the absorptivity can be raised can be caused to display predetermined information. In such a case, there is the following advantage. Generally, the part where the absorptivity for the first wavelength of light can be raised in the optical reflective layer is different in reflection spectrum from the part corresponding to the pattern of the optical absorptive pattern layer. Therefore, the pattern image displayed when the first wavelength of light is irradiated may be different from the pattern image displayed when the other wavelength of light different from the first wavelength of light is irradiated. Accordingly, it is possible for a person who does not know using the first wavelength of light to read the previous information.

When the wavelength of light (the first wavelength of light) is irradiated, at least a part of the pattern of the optical absorptive pattern and the pattern of the optical absorptive pattern of the part where the absorptivity can be raised in advance in the optical reflective layer can display different kinds of information. Even in such a case, it is possible for a person who does not know using the first wavelength of light to read the information displayed by the part where the absorptivity for the first wavelength of light can be raised in the optical reflective layer.

When the wavelength is in the infrared area, the optical functional layer may be a black layer. In this case, "black" means that the reflectance is equal to or less than 10% with respect to all the optical components in which the wavelength is in the range of 400 nm to 700 nm, when the intensity of regular reflection light is measured. A considerable number of materials used in the optical reflective layer are colored or discolored, the coloring or the discoloring generated in the optical reflective layer can be recognized by observation with the naked eye, and the irreversible change of the lamination unit is recognized. However, according to the aspect, at least a part of the optical reflective layer is covered by the optical functional layer of the black layer. Accordingly, when this part is heated, the irreversible change of the lamination unit cannot be easily viewed.

When the wavelength is in a near-infrared region, the transmittance of the optical functional layer with respect to the wavelength can be equal to or more than 30%, and the transmittance difference of any wavelength of the wavelength band of 700 to 800 nm of the near-infrared area and the wavelength band of 800 to 1500 nm can be equal to or more than 10%. In such a case, the transmission spectrum of the optical functional layer in the near-infrared area represents high transmittance with respect to the first wavelength of light, but the transmittance difference of any wavelength of the wavelength band of 700 to 800 nm of the near-infrared area and the wavelength band of 800 to 1500 nm of the near-infrared area is equal to or more than 10%. Accordingly, it is impossible or difficult for a person who does not know using the first wavelength of light in the irreversible change of the lamination unit to determine the irreversible change between the lamination unit before the light reception of the optical reflective layer and the lamination unit after the light reception. For this reason, according to the aspect, it is difficult for a person who does not know using the first wavelength of light in the irreversible change of the lamination unit to recognize the irreversible change of the lamination unit.

The optical functional layer and the optical reflective layer may be directly formed on the cartridge surface or adhered to the cartridge surface.

APPLICATION EXAMPLE 2

Cartridge

According to Application Example 2, there is provided a cartridge which accommodates a printing material used for printing, wherein an optical functional layer that allows predetermined wavelength of light to pass, and an optical reflective layer that has a property and a state in which absorptivity of the wavelength of light is irreversibly raised and reflects the wavelength of light are laminated and provided, and wherein the optical functional layer is positioned on an incident side of the wavelength of light.

According to the cartridge having the configuration described above, it is possible to obtain the effect described above.

APPLICATION EXAMPLE 3

Cartridge Label

According to Application Example 3, there is provided a cartridge label which is attached to a cartridge accommodating a printing material used for printing, wherein an optical functional layer that allows predetermined wavelength of light to pass, and an optical reflective layer that has a property and a state in which absorptivity of the wavelength of light is irreversibly raised and reflects the wavelength of light are laminated and provided.

The cartridge label is attached to the cartridge, and thus it is possible to obtain the effect described above.

APPLICATION EXAMPLE 4

Printing Apparatus

According to Application Example, 4, there is provided a printing apparatus which is provided with the cartridge described above, including an irreversible treatment unit that performs an irreversible treatment of applying heat to the optical reflective layer such that absorptivity of the optical reflective layer in the wavelength is irreversibly raised in advance.

When the cartridge described above is mounted, the printing apparatus having the configuration described above performs the irreversible treatment on the lamination unit of the mounted cartridge. In the irreversible treatment, the heat is added to the optical reflective layer such that the absorptivity of the optical reflective layer in the wavelength in the lamination unit is raised. According to a printing apparatus having the configuration described above, the lamination unit can cause the irreversible change through the irreversible treatment.

The printing apparatus described above may be embodied as the following aspect. For example, the optical functional layer is irradiated with the wavelength of light to read the reflection state, and reflection state read by the reading unit before and after the irreversible treatment is contrasted. In such a manner, the lamination unit can perform a treatment corresponding to the irreversible change described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
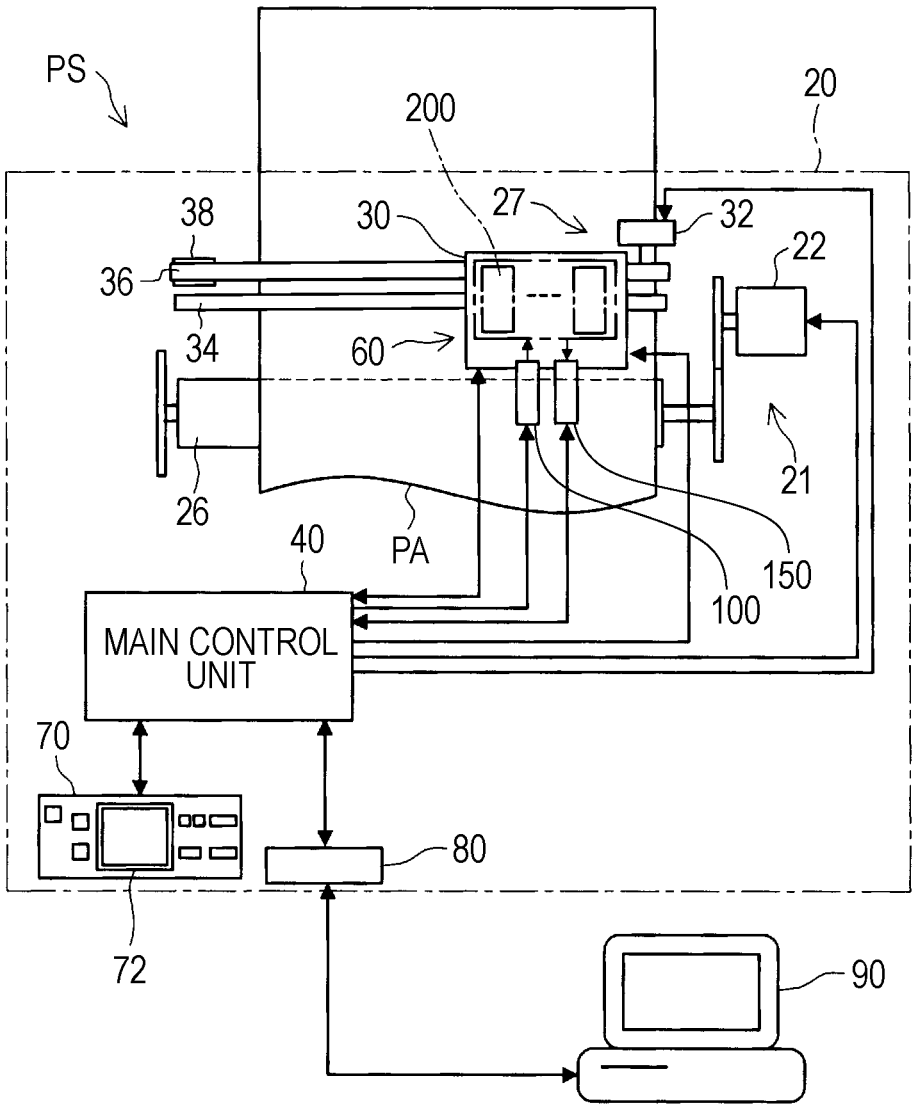
FIG. 1 is a diagram illustrating a schematic configuration of a printing system.

Hereinafter, an example of a printing system according to an embodiment will be described. FIG. 1 is a diagram illustrating a schematic configuration of a printing system PS. As shown in FIG. 1, the printing system PS includes a printer 20 as a printing apparatus, and a computer 90. The printer 20 is connected to the computer 90 through a connector 80.

The printer 20 includes a sub-scanning transport mechanism 21, a main scanning transport mechanism 27, a printing head unit 60, and a main control unit 40. The sub-scanning transport mechanism 21 includes a sheet transport motor 22, and a sheet transport roller 26, and transports a sheet PA in the sub-scanning direction using the sheet transport roller 26. The main scanning transport mechanism 27 includes a carriage motor 32, a pulley 38, a driving belt 36 provided between the carriage motor 32 and the pulley 38, and a sliding shaft 34 provided in parallel to the sheet transport roller 26. The sliding shaft 34 is slidably provided with the carriage 30 fixed to the driving belt 36. The rotation of the carriage motor 32 is transferred to the carriage 30 through the driving belt 36, and the carriage 30 is reciprocally moved in the main scanning direction parallel to the axial direction of the sheet transport roller 26 along the sliding shaft 34.

The printing head unit 60, in which the carriage 30 is provided with an ink cartridge 200 and a printing head (not shown), drives the printing head while the printing head unit 60 is driven in the main scanning direction by the carriage 30, and eject the ink accommodated in the ink cartridge 200 onto the sheet PA. The main control unit 40 controls the mechanisms to realize a printing process. The main control unit 40 receives a printing job of a user, for example, through a computer 90, and control the mechanisms described above to perform the printing on the basis of the content of the received printing job. Each ink cartridge 200 is detachably mounted on the carriage 30. The printing head has a plurality of nozzle rows for ejecting different inks. The printing head unit 60 includes a heating unit 100 and a reading unit 150. The heating unit 100 performs heat radiation on the label unit 210 provided on the ink cartridge 200 to be described later. The reading unit 150 performs light irradiation to the label unit 210, and reading of the reflection light thereof. The heating or reading performed on the label unit 210 will be described later.

The printer 20 is provided with an operation unit 70 for performing various settings of the printer 20 by a user, or for confirming a status of the printer 20. The operation unit 70 is provided with a display unit 72 for performing various reports to the user.

Figure 2:
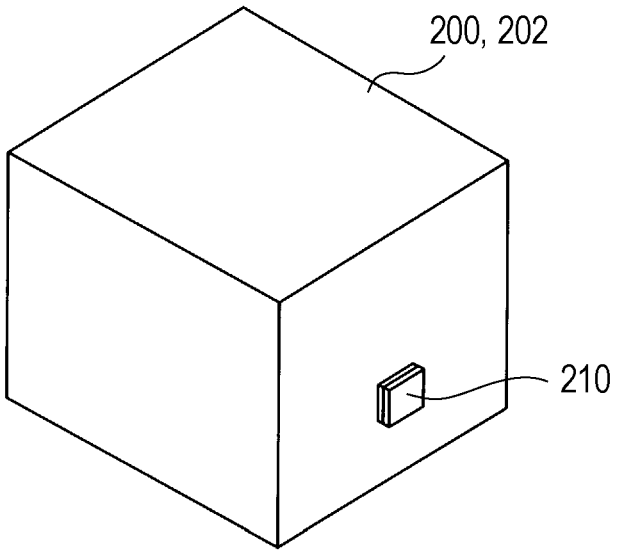
FIG. 2 is a diagram schematically illustrating an ink cartridge and a label portion.
Figure 3:
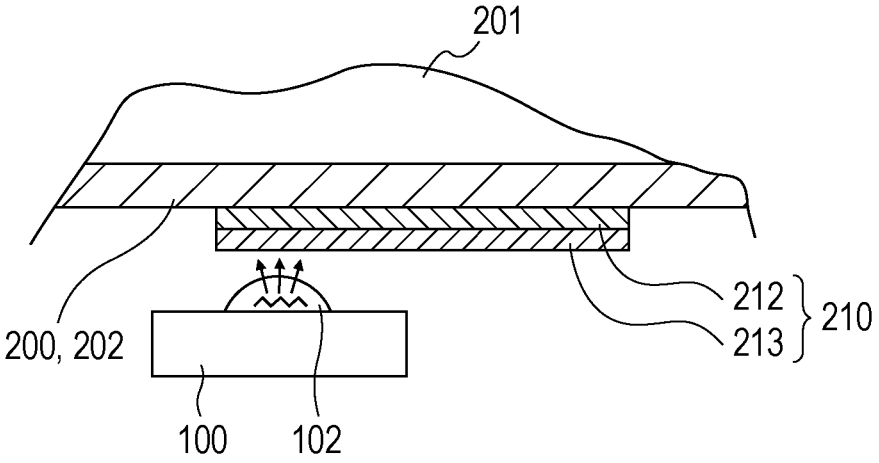
FIG. 3 is a diagram illustrating a relationship between a label portion of the ink cartridge and a heating unit.

FIG. 2 is a diagram schematically illustrating the ink cartridge 200 and the label unit 210, and FIG. 3 is a diagram illustrating a relationship between the label unit 210 of the ink cartridge 200 and the heating unit 100.

As shown in FIG. 2, the label unit 210 is formed on one peripheral wall surface of a case 202 forming an ink accommodating unit 201 in the ink cartridge 200. The label unit 210 has a lamination structure in which a plurality of layers with different properties and states are laminated, and includes an optical functional layer 213 that allows predetermined wavelength of light (hereinafter, this wavelength is referred to as a first wavelength, and the light is referred to as a first wavelength of light) to pass, and an optical reflective layer 212 that reflects the first wavelength of light, and the optical reflective layer 212 is the surface side of the case 202.

The optical reflective layer 212 has a property and a state of irreversibly raising the absorptivity of the first wavelength of light by heat reception, and is a thin film layer using an ink representing such a property and state. The optical reflective layer 212 reflects the first wavelength of light in a period until the irreversible treatment to be described later is performed by the heating unit 100. When the heat is received at a temperature (hereinafter, referred to as an irreversible change temperature) heated at the time of the irreversible treatment, the absorptivity with respect to the first wavelength of light is irreversibly raised. After forming the label unit 210 on the ink cartridge 200, a reflectance R1 of the optical reflective layer 212 with respect to the first wavelength of light is, for example, in the range of 50 to 100%, and generally in the range of 60 to 80%. After the irreversible treatment, a reflectance R2 of the optical reflective layer 212 with respect to the first wavelength of light is, for example, in the range of 0 to 30%, and generally in the range of 5 to 20%. A ratio of the reflectance R2 and the reflectance R1 is, for example, in the range equal to or less than 0.6, and generally in the range of 0.06 to 0.33.

The optical reflective layer 212 includes a heat sensitive coloring agent that is colored by receiving heat equal to or higher than an irreversible change temperature. For example, The heat sensitive coloring agent is colorless during a period until it is heated equal to or higher than an irreversible change temperature, and is colored by heating equal to or higher than the irreversible change temperature. Alternatively, for example, the heat sensitive coloring agent is colored to black during a period until it is heated to equal to or higher than the irreversible temperature, and is color-changed by heating to equal to or higher than the irreversible change temperature. As described above, when the optical reflective layer 212 includes the heat sensitive coloring agent, the optical reflective layer 212 generally is colored or color-changed by heating equal to or higher than the irreversible change temperature.

In the embodiment, as an example, the optical reflective layer 212 includes the heat sensitive coloring agent in which the absorptivity in the wavelength band of at least a part of the near-infrared area is irreversibly raised by coloring or color-changing. Herein, the "near-infrared area" means a wavelength band of 700 to 1500 nm. The wavelength of the first wavelength of light is in the wavelength band in which the absorptivity is irreversibly raised by coloring or color-changing, in the near-infrared area.

The heat sensitivity coloring agent may be, for example, a combination of a dye such as a leuco dye and a color developing agent. Alternatively, a heat sensitive coloring compound such as a fluorene compound disclosed in JP-A-59-199757 and a divinyl compound disclosed in JP-A-62-243653 may be used. For example, heat sensitive coloring compositions disclosed in JP-A-6-24140, JP-A-7-172050, and JP-A-10-100544 may be used.

The optical reflective layer 212 may further include another component. For example, the optical reflective layer 212 may further include resin as a dispersion medium that disperses the heat sensitivity coloring agent. The resin may be, for example, resin generally used in a process ink.

The optical reflective layer 212 may be formed, for example, by a printing method. The printing method may be, for example, an offset printing method, a gravure printing method, a screen printing method, or a flexo printing method. A thickness of the optical reflective layer 212 is, for example, in the range of 1 to 20 μm, and generally, in the range of 3 to 15 μm. To form the optical reflective layer 212 on the surface of the case 202, the ink cartridge 200 is set in the printing apparatus of the printing method described above, an ink A having the following composition is applied onto the surface of the case 202 using, for example, a bar coater, and a dried film thickness at that time is 10 μm. By drying the coating film, it is possible to print and form the optical reflective layer 212 on the surface of the case 202.

Composition of Ink A

Infrared Absorption Leuco Dye (NIR BLACK 78: manufactured by Yamada Chemical Industries, Ltd.) 1 part by mass;

Color Developing Agent (TG-SH(H): manufactured by Nippon Kayaku Co., Ltd.) 7 parts by mass;

Aqueous Resin (Hydran AP-40: manufactured by DIC Co., Ltd.)

12 parts by mass

The optical functional layer 213 formed on the optical reflective layer 212 allows the first wavelength of light to pass. The transmittance of the optical functional layer 213 with respect to the first wavelength of light is, for example, equal to or more than 30%, and generally in the range of 30 to 60%.

Generally, the optical functional layer 213 is colored. When the optical function layer 213 is colored, particularly when the optical functional layer 213 is colored to black, and even when the optical reflective layer 212 is colored or color-changed by heating, it is impossible or difficult to recognize it by observing the label unit 210 from the front face side (that is, the side of the optical functional layer 213) with the naked eye only. That is, when the optical functional layer 213 is colored, it is difficult to recognize performing of the irreversible treatment to be described later. Herein, as an example, the optical functional layer 213 represents black.

When the first wavelength is in the near-infrared area, the optical functional layer 213 in which the transmittance in the first wavelength is equal to or more than 30% as the optical functional layer 213, and a transmittance difference of any wavelength of the wavelength band of 700 to 800 nm of the near-infrared area and the wavelength band of 800 to 1500 nm of the near-infrared area is equal to or more than 10% may be used. That is, in the optical functional layer 213, transmittance spectrum in the near-infrared area represents high transmittance with respect to the first wavelength, and may represent low transmittance in the other wavelengths. Herein, as an example, the optical functional layer 213 has such optical characteristics. Herein, in the second wavelength different from the first wavelength or in the near-infrared area, the transmittance of the optical functional layer 213 in the second wavelength is equal to or less than transmittance of the optical functional layer 213 in the first wavelength, for example, is equal to or less than 10% of the transmittance of the optical functional layer 213 in the first wavelength.

The optical functional layer 213 having the optical characteristics, that is, the optical characteristics of allowing the light in a part of the wavelength band to selectively pass and absorbing the other light includes, for example, a predetermined near-infrared absorbing agent and resin. The near-infrared absorbing agent may be, for example, at least one selected from the group consisting of a phthalocyanine compound, a phthalocyanine compounds, an anthraquinone compound, a diimonium compound, an a cyanine compound. The resin may be, for example, resin generally used in the process ink.

Similarly to the optical functional layer 212, the optical functional layer 213 is formed by a printing method such as the offset printing method, the gravure printing method, the screen printing method, and the flexo printing method. A thickness of the optical reflective layer 213 is, for example, in the range of 0.5 to 10 μm, and generally, in the range of 1 to 5 μm. To form the optical functional layer 213, for example, the ink cartridge 200 in which the optical reflective layer 212 is formed is set in the offset printing apparatus, an ink B or an ink C with the following composition is printed to overlap with the formed optical reflective layer 212, and a dried film thickness at that time is 1 μm. Thereafter, the coating film is irradiated with ultraviolet light such that the optical functional layer 213 is formed to overlap with the optical reflective layer 212. As described above, the label unit 210 in which the optical functional layer 213 is laminated on the optical functional layer 212 was observed from the side of the surface of the case 202 with the naked eye, and the whole was viewed as black. That is, in the ink cartridge 200 of the embodiment, the optical functional layer 213 is positioned on the incident side of the optical functional layer 213 with respect to the label unit 210.

Composition of Ink B

Organic Blue Pigment (manufactured by Mikuni Color Ltd.) 5 parts by mass;

Organic Red Pigment (manufactured by Mikuni Color Ltd.) 7 parts by mass;

Organic Yellow Pigment (manufactured by Mikuni Color Ltd.) 8 parts by mass;

UV Curable Offset Ink Medium (FD Carton ACD Medium B: manufactured by Toyo Ink Co., Ltd.) 80 parts by mass;

Composition of Ink C

Organic Blue Pigment (manufactured by Mikuni Color Ltd.) 5 parts by mass;

Organic Red Pigment (manufactured by Mikuni Color Ltd.) 7 parts by mass;

Organic Yellow Pigment (manufactured by Mikuni Color Ltd.) 8 parts by mass;

Infrared Absorbing Agent (YKR-3081: manufactured by Yamamoto Chemicals, Inc.) 5 parts by mass;

UV Curable Offset Ink Medium (FD Carton ACD Medium B: manufactured by Toyo Ink Co., Ltd.) 75 parts by mass;

As shown in FIG. 3, the heating unit 100 is opposed to the label unit 210 on the cartridge surface in the ink cartridge 200. In this case, the heating unit 100 may be constantly opposed to the label unit 210 of the ink cartridge 200, and the heating unit 100 is set in a 2-dimensional table or a 3-dimensional table and may be retractable with respect to the label unit 210. The heating unit 100 is provided with a thermal head 102 to face the label unit 210, and heats the label unit 210 from the side of the optical functional layer 213 in the thermal head 102 by a control of the main control unit 40 (FIG. 1). In the heating, the heat of 120° C. (the irreversible change temperature) colored after the absorptivity of the optical reflective layer 212 formed with the ink composition (the ink A) in the first wavelength is irreversibly raised is added to the optical reflective layer 212. That is, the heating unit 100 performs the irreversible treatment of adding the heat to the optical reflective layer 212 at the temperature described above, at the control timing from the main control unit 40. The optical reflective layer 212 is subjected to the irreversible treatment, specifically, is subjected to the heat reception of the temperature, and irreversible increase and coloring of the absorptivity in the first wavelength is caused. When the heat reception is performed on the optical reflective layer 212 as described above in the thermal head 102, the thermal head 102 may come in contact with the surface of the label unit 210.

Figure 4A:
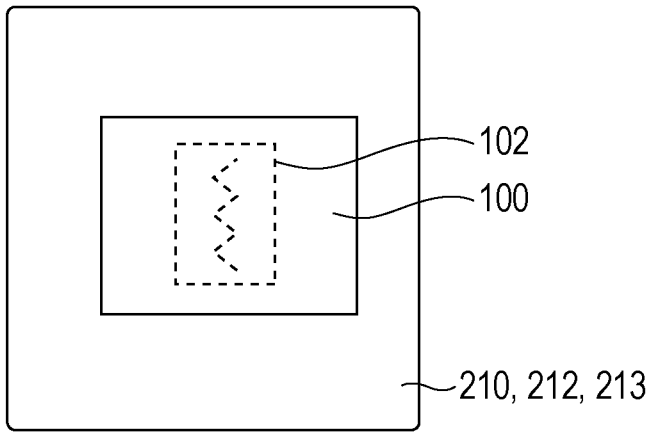
FIG. 4A and FIG. 4B are diagrams illustrating a positional relationship between the label portion and the heating unit while viewing the label portion in the front view from the side of an optical functional layer.
Figure 4B:
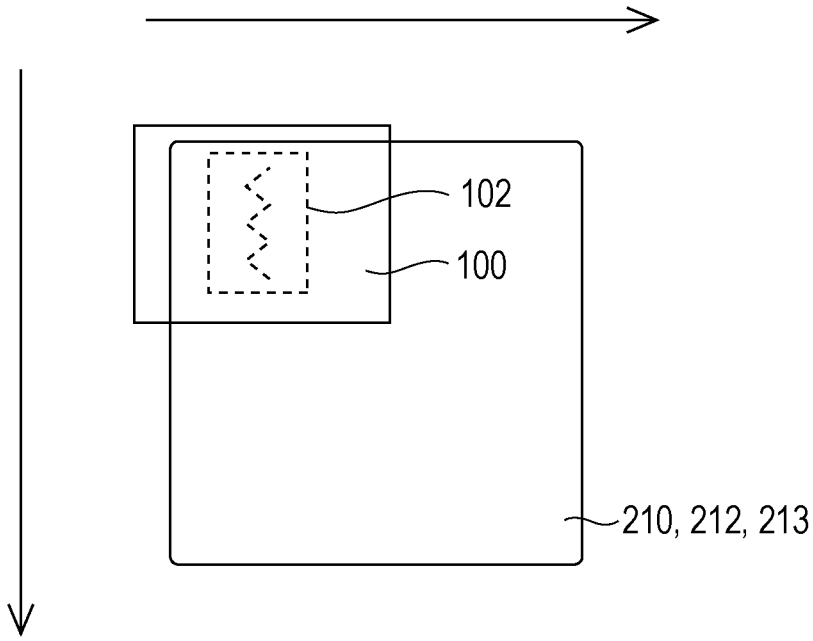
Figure 5:
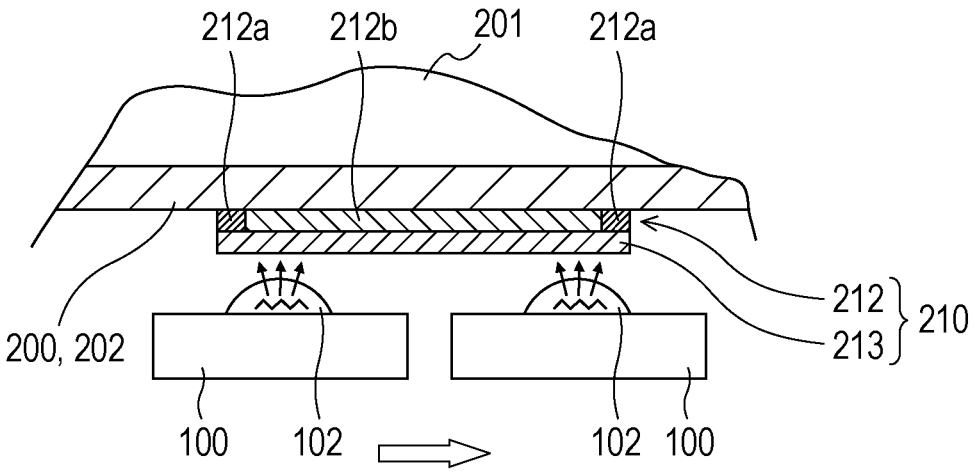
FIG. 5 is a diagram schematically illustrating change of an optical reflective layer when the heating unit is moved with respect to the label portion.

FIG. 4A and FIG. 4B are front views illustrating a positional relationship between the label unit 210 and the heating unit 100 while viewing the label unit 210 from the side of the optical functional layer 213, and FIG. 5 is a diagram schematically illustrating change of the optical reflective layer 212 when the heating unit 100 is moved with respect to the label unit 210. As shown in FIG. 4A and FIG. 4B, in the heating unit 100, the thermal head 102 thereof may be opposed to only one part of the label unit 210 (FIG. 4A), and may be scanned vertically and horizontally with respect to the label unit 210 or in one direction thereof (FIG. 4B) by the 2-dimensional or 3-dimensional table described above. In the case shown in FIG. 4A, by the irreversible treatment based on the heating unit 100, in the label unit 210, specifically, in the optical reflective layer 212, irreversible increase or coloring of the absorptivity occurs in the heat reception range at one part of the heating unit 100 opposed to the thermal head 102. Meanwhile, in the case shown in FIG. 4B, a trace similar to a scanning trace of the heating unit 100 is the heat reception range. Accordingly, in the optical reflective layer 212, the irreversible increase and coloring of the absorptivity occurs in a continuous heat reception range similar to the scanning trance of the thermal head 102. FIG. 5 shows the change of the optical reflective layer 212 when the heating unit 100 is moved in one direction. In the movement range of the heating unit 100, the optical reflective layer 212 is a heat reception portion 212*b* from a non-heat reception portion 212*a* which is not subjected to the heat reception, and the irreversible increase and coloring of the absorptivity in the first wavelength is caused as described above in the heat reception portion 212*b*.

Figure 6:
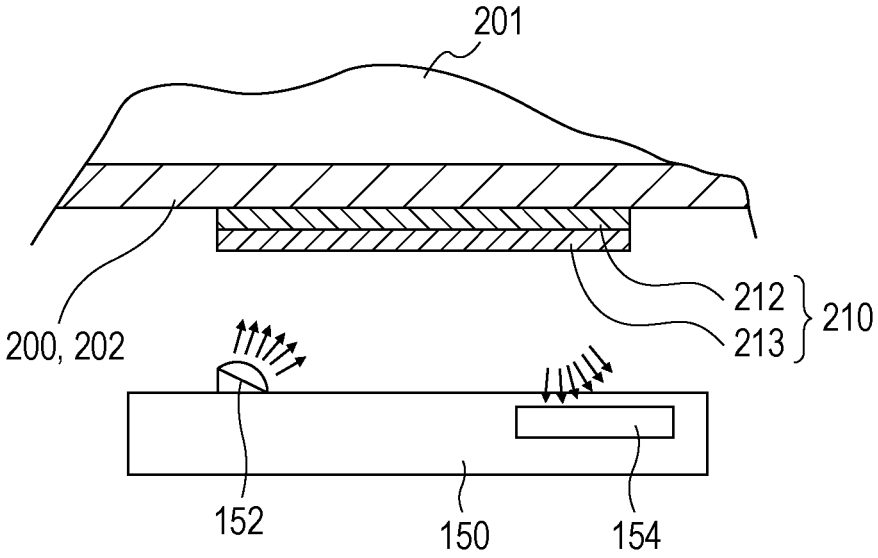
FIG. 6 is a diagram illustrating a function of a reading unit and the label portion.

FIG. 6 is a diagram illustrating a relationship between a function of the reading unit 150 and the label unit 210. As shown in FIG. 6, the reading unit 150 is opposed to the label unit 210 on the cartridge surface in the ink cartridge 200. In this case, similarly to the heating unit 100, the reading unit 150 may be also constantly opposed to the label unit 210, the reading unit 150 is set in a 2-dimensional table or a 3-dimensional table and is retractable with respect to the label unit 210. The reading unit 150 is provided such that the irradiation unit 152 and the light receiving unit 154 are opposed to the label unit 210 by receiving the control from the main control unit 40 (FIG. 1), and performs light irradiation by the irradiation unit 152 and reading by the light receiving unit 154. The irradiation unit 152 is provided therein with an infrared LED (light-emitting diode), and irradiates light (the first wavelength of light) with a wavelength of 800 nm as the first wavelength. The light receiving unit 154 is formed of a CCD (charge-coupled device) camera, and the light irradiated from the irradiation unit 152 is reflected by the optical reflective layer 212, the light receiving unit 154 receives the reflection light. In this case, the light receiving unit 154 is configured to receive the light of the infrared area including the first wavelength by an optical filter (not shown).

Figure 7:
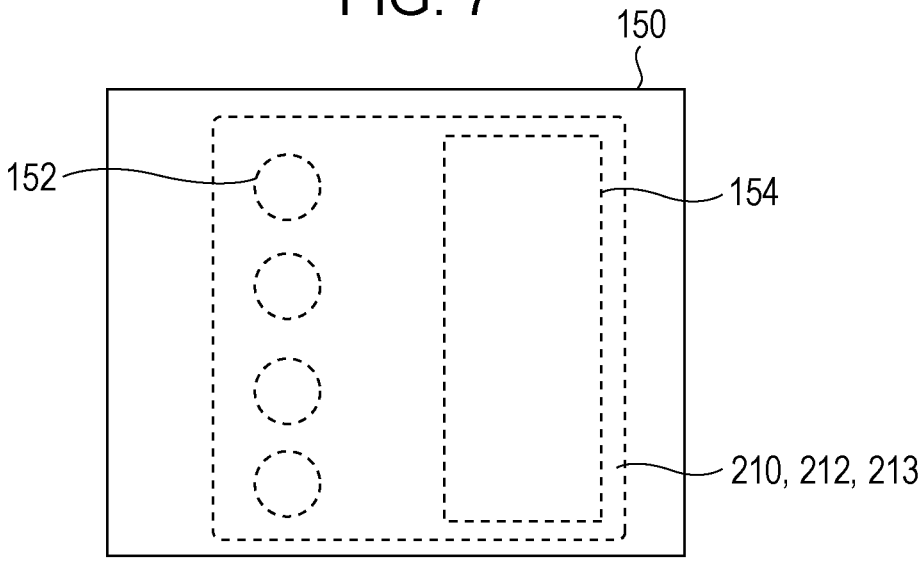
FIG. 7 is a front view illustrating a positional relationship between the label portion and the reading unit while viewing the optical functional layer from the side of the optical functional layer.

FIG. 7 is a front view illustrating a positional relationship between the label unit 210 and the reading unit 150 while viewing the label unit 210 from the side of the optical function layer 213. As shown in FIG. 7, the reading unit 150 irradiates the wavelength (the first wavelength) light from the plurality of irradiation units 152 to the front face of the label unit 210, and the light receiving unit 154 receives the reflection light from the front face of the label unit 210. Accordingly, even in the irreversible treatment by the heating unit 100 in a case of the difference described in FIG. 4A and FIG. 4B, the reading unit 150 can read the reflection state represented by the optical reflective layer 212 in which the irreversible increase and coloring of the absorptivity is caused by the irreversible treatment.

The printer 20 performs the irreversible treatment using the thermal head 102 by the heating unit 100, at the timing (the irreversible change timing) when the ink accommodated in the ink cartridge 200 is wasted. Specifically, the main control unit 40 acquires the ink remaining amount of the ink cartridge 200 from accumulation of the processed printing job, and transmits a control signal to the heating unit 100 when the remaining amount becomes an ink amount in which the next printing job cannot be performed. The heating unit 100 receives the control signal, and raises the temperature of the thermal head 102 to the temperature of 120° C., and radiates the heat to the optical reflective layer 212 of the label unit 210. The time of the heat radiation is sufficient in that the optical reflective layer 212 receives the heat to cause the irreversible increase and coloring of the absorptivity. When the heating unit 100 is scanned as shown in FIG. 4B, the heat radiation time is secured while adjusting the scanning speed.

When the ink cartridge 200 is mounted on the carriage 30, the printer 20 transmits a control signal from the main control unit 40 to the reading unit 150 at the timing (the reading timing). The reading unit 150 performs the light irradiation by the irradiation unit 152 and the reading of the reflection light by the light receiving unit 154, and transmits the reading result to the main control unit 40. The main control unit 40 stores the reading situation before the irreversible treatment by the heating unit 100 in advance, and compares the reading result of the light receiving unit 154 with the stored reading situation, and it is possible to specify whether the ink cartridge 200 newly mounted on the carriage 30 is subjected to the irreversible treatment or is subjected to the treatment.

According to the printing system PS of the embodiment described above, there is the following advantage. The ink cartridge 200 of the embodiment is provided with the label unit 210 on the surface of the case 202, the label unit 210 is the lamination unit in which the optical reflective layer 212 and the optical functional layer 213 are laminated from the cartridge surface face side. In the state where the ink cartridge 200 is mounted on the carriage 30 as shown in FIG. 1, the label unit 210 is subjected to the irreversible treatment through the heating unit 100 provided in the printing head unit 60 of the printer 20 at the irreversible change timing. The optical reflective layer 212 of the label unit 210 is subjected to the irreversible treatment and is heated by the terminal head 102 of the heating unit 100, to cause the irreversible increase and coloring of the absorptivity with respect to the first wavelength (800 nm) in the heat reception range (see FIG. 4A and FIG. 4B). For this reason, in the optical reflective layer 212 of the label unit 210, the absorptivity with respect to the first wavelength of light (the light with the wavelength of 800 nm) is different from the heat reception range before and after the irreversible treatment with the heat reception.

Meanwhile, the printer 20 irradiates the label unit 210 of the ink cartridge 200 with the first wavelength of light (the light with the wavelength of 800 nm) from the side of the optical functional layer 213 from the irradiation unit 152 of the reading unit 150 at the reading timing where the ink cartridge 200 is mounted on the carriage 30, and reads the reflection state of the first wavelength of light from the optical functional layer 213 by the light receiving unit 154 (see FIG. 6 and FIG. 7). When the ink cartridge 200 newly mounted on the carriage 30 is a cartridge that fully accommodates a predetermined ink without being mounted in advance on the carriage 30, the cartridge was not subjected to the irreversible treatment by the heating unit 100. Accordingly, in the reading result with respect to the newly mounted ink cartridge 200 by the light receiving unit 154, the irreversible increase and coloring of the absorptivity with respect to the first wavelength of light (the light with the wavelength of 800 nm) are not caused.

Meanwhile, when the ink cartridge 200 newly mounted on the carriage 30 is previously subjected to the irreversible treatment by the heating unit 100, in the reading result with respect to the newly mounted ink cartridge 200 by the light receiving unit 154, the irreversible increase and coloring of the absorptivity with respect to the first wavelength of light (the light with the wavelength of 800 nm) is reflected. That is, the change of the irreversible absorptivity of the optical reflective layer 212 of the label unit 210 subjected to the irreversible treatment corresponds to electrical data update in the storage element, for example, update of information of updating a data value from 0 to 1 or reversely. Therefore, according to the ink cartridge 200 of the embodiment, the irreversible change of the label unit 210 corresponds to the electrical data update in the storage element, for example, the update of information of updating the data value from 0 to 1 or reversely, thus corresponds to the update of information, and the storage element is not necessary. The storage element may be used commonly with the label unit 210.

According to the printer 20, the irreversible change of the absorptivity of the optical reflective layer 212 in the label unit 210 is caused at the timing when the ink of the ink cartridge 200 is used up. Accordingly, even when the ink cartridge 200 in which the ink is used up is erroneously mounted on the carriage 30, the erroneous mounting is displayed on the display unit 72 of the operation unit 70 for use to know it, and thus the storage element is not necessary in such recognition. The storage element may be used commonly with the label unit 210.

In the printer 20 of the embodiment, the irreversible treatment is performed at the timing when the ink of the ink cartridge 200 is used up, the absorptivity of the optical reflective layer 212 in the label unit 210 is irreversibly raised, and it is difficult to return the absorptivity of the optical reflective layer 212 to the state before the irreversible treatment. Accordingly, as for the ink cartridge 200 for which it is difficult to know whether or not it is an honest product, it is possible to determine whether to perform the irreversible treatment on the label unit 210. This means that it is possible to determine the authenticity of the ink cartridge 200 for which it is difficult to know whether or not it is the honest product. Accordingly, it is possible to prevent the label unit 210 from being peeled off to try to reuse.

Figure 8:
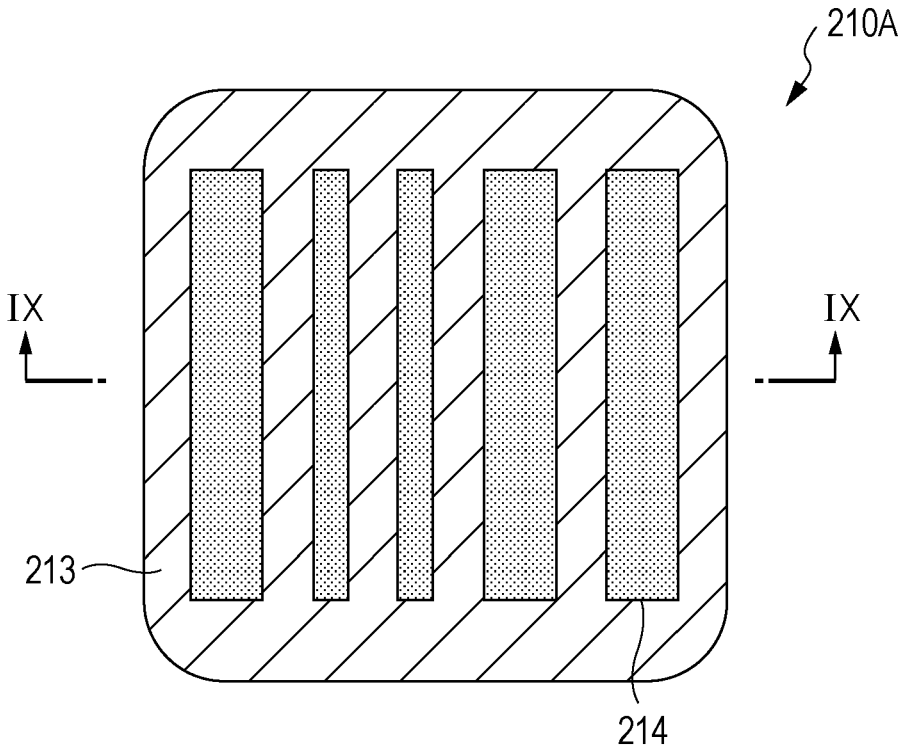
FIG. 8 is a front view illustrating a label portion of a modification example.

Next, modification examples will be described. FIG. 8 is a front view illustrating a label unit 210A of a modification example, and FIG. 9 is a cross-sectional view of IX-IX of FIG. 8.

Figure 9:
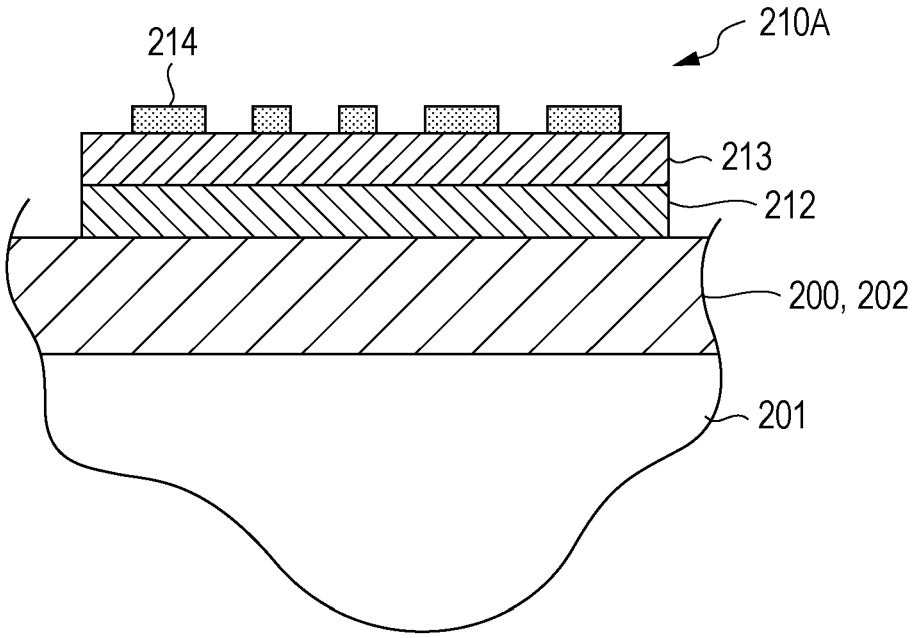
FIG. 9 is a cross-sectional view of IX-IX of FIG. 8.

As shown in FIG. 8 and FIG. 9, in the label unit 210A of the modification example, the optical reflective layer 212 and the optical functional layer 213 are laminated on the surface of the case 202 of the ink cartridge 200, and then an optical absorptive pattern layer 214 is laminated on the optical functional layer 213. In the optical absorptive pattern layer 214, a 1-dimensional code pattern shown in FIG. 8 is formed of a material to be described later on the optical functional layer 213, and faces the optical reflective layer 212 with the optical functional layer 213 interposed therebetween. In the example shown in FIG. 8 and FIG. 9, the pattern of the optical absorptive pattern layer 214 is the 1-dimensional code, but may be a 2-dimensional code pattern or the other pattern such as a character, a symbol, a shape, and a figure. When the pattern of the optical absorptive pattern layer 214 is different according to unique information in the ink cartridge 200, for example, an ink color, it is possible to specify the ink color from the reading result at the time of mounting the cartridge.

The optical absorptive pattern layer 214 absorbs the first wavelength of light described above. Specifically, the absorptivity of the optical absorptive pattern layer 214 in the first wavelength is more than the absorptivity of the optical reflective layer 212 in the first wavelength and the absorptivity of the optical functional layer 213 in the first wavelength just after the production of the label unit 210A. The absorptivity of the optical absorptive pattern layer 214 in the first wavelength is, for example, equal to or more than 70%, and generally equal to or more than 80%.

When the first wavelength is in the near-infrared area, the optical absorptive pattern layer 214 contains, for example, a near-infrared absorbing agent and resin. As the resin, for example, resin generally used in the process ink may be used.

The near-infrared absorbing agent used herein, generally, the near-infrared absorbing agent used in the optical functional layer 213 has a difference in absorptive spectrum of the near-infrared area. For example, the absorptivity of the near-infrared absorbing agent used herein with respect to the first wavelength of light is more than the near-infrared absorbing agent used in the optical functional layer 213. The near-infrared absorbing agent may be, for example, carbon black used in the process ink. Alternatively, the near-infrared absorbing agent may be the compound exemplified as the near-infrared absorbing agent of the optical functional layer 213.

The optical absorptive pattern layer 214 preferably has the same color as that of the optical functional layer 213, or a light color as long as it represents sufficient absorptivity with respect to the first wavelength of light. In this case, when the label unit 210A is observed with the naked eye, it is difficult to know the presence of the optical absorptive pattern layer 214.

The optical absorptive pattern layer 214 is preferably distributed over the whole area of the area corresponding to the optical reflective layer 212. In this case, it is difficult to analyze the spectrum characteristics of the optical functional layer 213.

The optical pattern layer 214 is formed by, for example, a printing method. The printing method may be, for example, an offset printing method, a gravure printing method, a screen printing method, and a flexo printing method. Alternatively, the optical absorptive pattern layer 214 may be formed using a thermal transfer ribbon. That is, the ink cartridge 200 in which the optical reflective layer 212 and the optical functional layer 213 are formed is processed by the printing method, and the optical absorptive pattern layer 214 is formed on the surface of the optical functional layer 213. A thickness of the optical absorptive pattern layer 214 is, for example, in the range of 0.5 to 10 μm, and generally, in the range of 0.5 to 2 μm.

Figure 10:
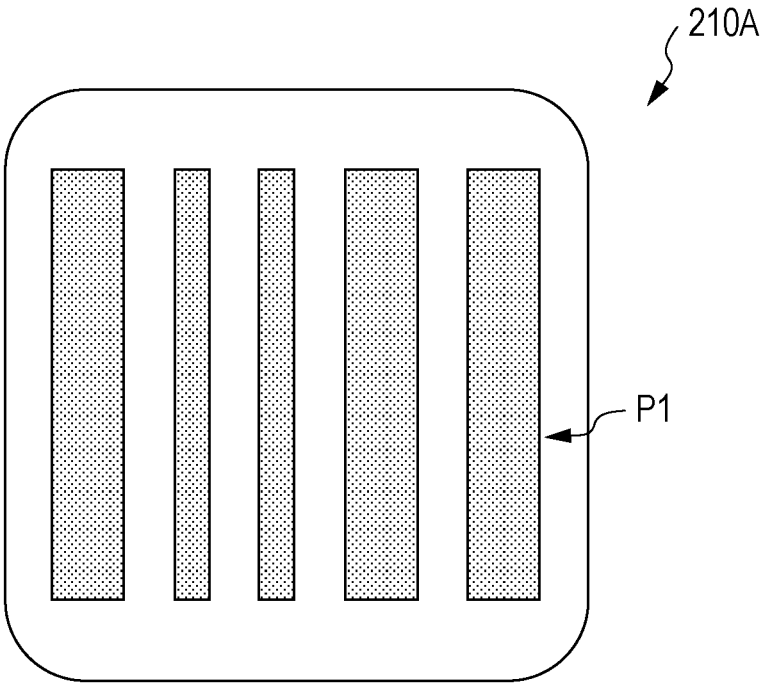
FIG. 10 is a diagram illustrating a reading image formed by reading a label portion before an irreversible treatment in a reading unit as shown in FIG. 6 and FIG. 7.

The irreversible treatment with respect to the ink cartridge 200 having the label unit 210A by the heating unit 100 and the reading result by the reading unit 150 will be described. FIG. 10 is a diagram illustrating the reading image formed by reading the label unit 210A before the irreversible treatment shown in FIG. 6 and FIG. 7 by the reading unit 150.

In the state where the label unit 210A is formed on the ink cartridge 200 accommodating the predetermined full amount of ink, when the label unit 210A is observed from the front face with the naked eye, for example, the whole is viewed as black (see FIG. 8). As shown in FIG. 6 and FIG. 7, when the irradiation unit 152 of the reading unit 150 irradiates the first wavelength of light and the light receiving unit 154 reads the reflection light thereof, the reading result of the light receiving unit 154 is a reading result corresponding to a pattern image P1 in which the area corresponding to the formed pattern of the optical absorptive pattern layer 214 is black and the area corresponding to the other part of the label unit 210A is white. The main control unit 40 receiving the reading result recognizes the pattern image P1 as an image. In this case, when the second wavelength of light of the infrared area different from the first wavelength of light is irradiated from the irradiation unit 152, the reading result of the light receiving unit 154 is, for example, a reading result in which the whole image is black or the pattern image P1 is displayed with a lower contrast ratio.

Figure 11:
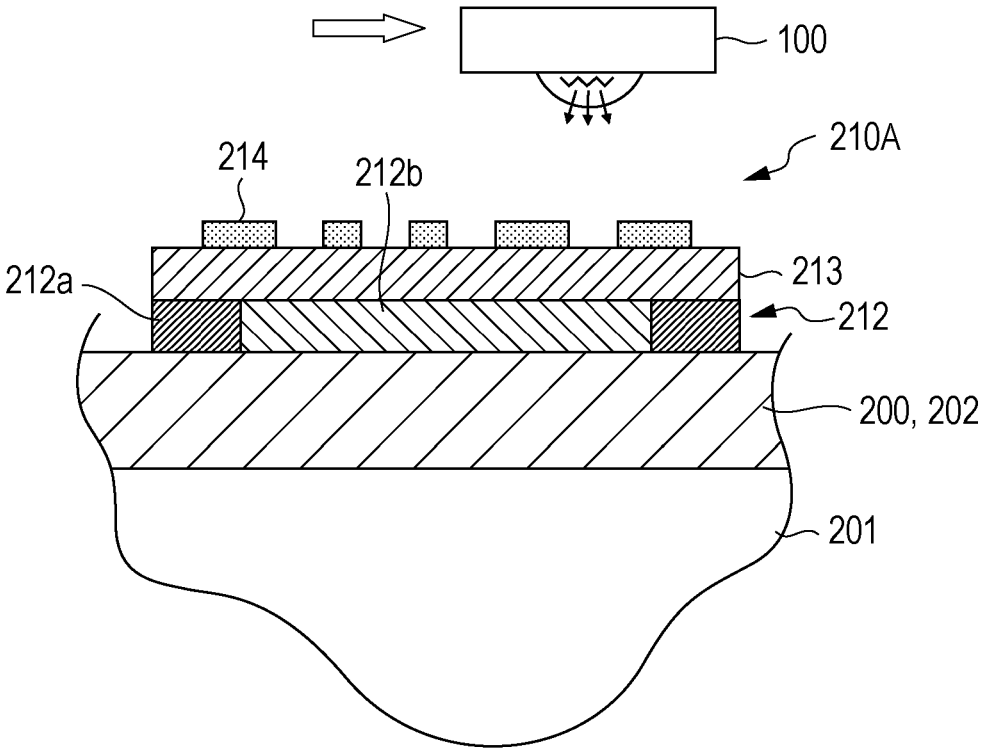
FIG. 11 is a diagram schematically illustrating the change in an optical reflective layer when a heating unit is moved with respect to the label portion, corresponding to FIG. 5.
Figure 12A:
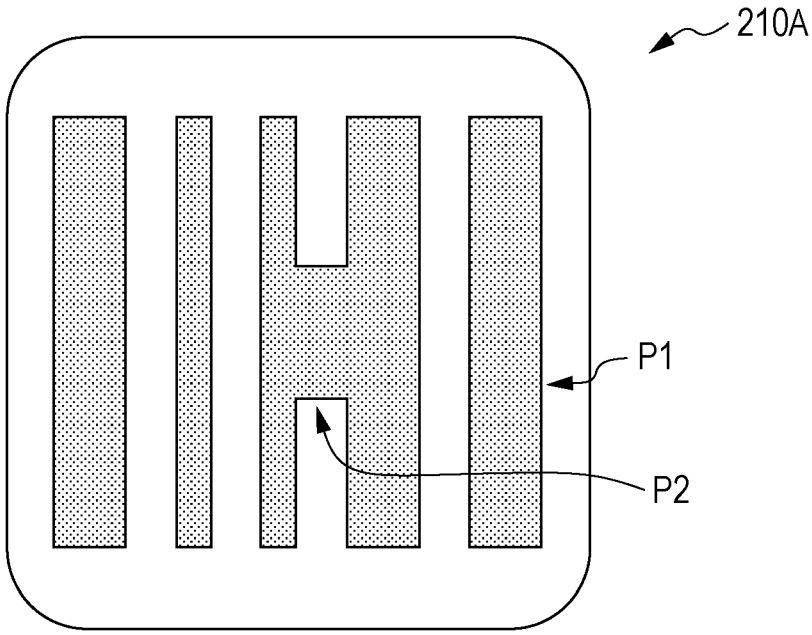
FIG. 12A and FIG. 12B are diagrams illustrating a pattern image based on the reading result of a light receiving unit after the irreversible treatment.
Figure 12B:
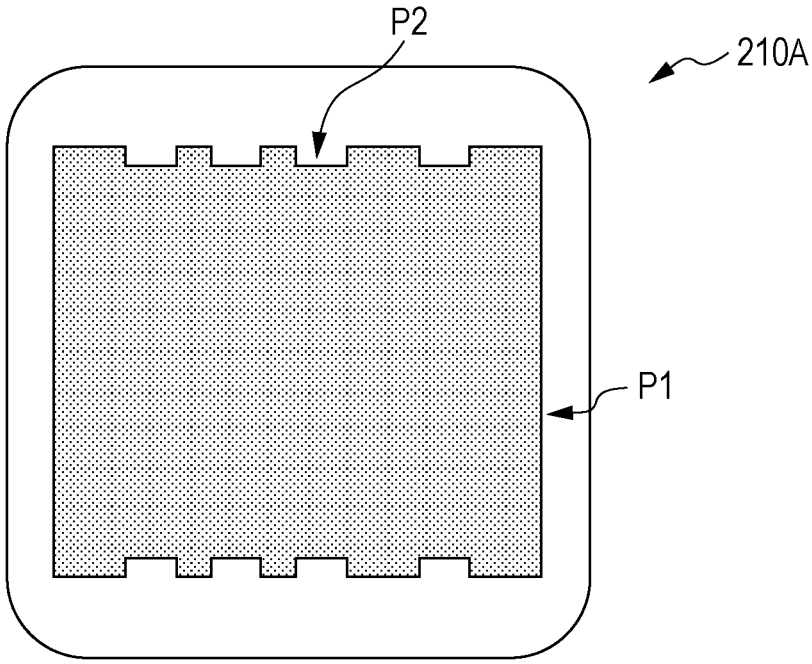

The ink of the ink cartridge 200 provided with the label unit 210A is used up in the printer 20 and the label unit 210A is subjected to the irreversible treatment by the heating unit 100 described above, it is as follows. FIG. 11 is a diagram corresponding to FIG. 5 and schematically illustrating the change of the optical reflective layer 212 when the heating unit 100 is moved with respect to the label unit 210A, and FIG. 12A and FIG. 12B are diagrams illustrating the pattern image based on the reading result by the light receiving unit 154 after the irreversible treatment. For example, as shown in FIG. 4A, when the irreversible treatment is performed with the heating unit 100 opposed to the label unit 210A, a new black pattern image P2 is generated in the heat reception portion 212*b* corresponding to the heat reception range by the irreversible increase and coloring of the absorptivity of the optical reflective layer 212 described above in the range (the heat reception range) corresponding to the heating unit 100, and the pattern image P2 is overlapped with the pattern P1 (see FIG. 12A). As shown in FIG. 4B, when the heating unit 100 is scanned with respect to the label unit 210A, a new black pattern image P2 is generated in the range of the heat reception portion 212*b* corresponding to the heat reception range similar to the scanning trace, the pattern image P2 is overlapped with the pattern image P1 (see FIG. 12B). The light receiving unit 154 transmits the reading result corresponding to the pattern image P1 with which the new black pattern image P2 is overlapped, to the main control unit 40, and thus the main control unit 40 recognizes the pattern image P1 with which the new pattern image P2 is overlapped. The reading result of the pattern image P1 can be obtained by the following reason.

In the label unit 210A subjected to the irreversible treatment by the heating unit 100, the first wavelength of light irradiated from the side of the optical functional layer 213 by the irradiation unit 152 is absorbed at the part corresponding to the pattern image P1 of the optical absorptive pattern layer, and the light quantity of the light reaching the optical reflective layer 212 is decreased. The light reaches the optical reflective layer at the part other than the pattern image P1. However, in the heat reception range, the absorptivity of the optical reflective layer 212 is raised. Accordingly, the small quantity of light reaches the optical reflective layer 212, and the reflectance of the first wavelength of light becomes lower. For this reason, a new black pattern image P2 is generated in the range corresponding to the heat reception range in which the reflectance is low, and is overlapped with the pattern image P1. As described above, when the optical reflective layer 212 is colored or color-changed by heating, and even when the color change is small or the transmittance of visible light of the optical functional layer 213 is low, it is impossible or difficult to determine the difference in color of the optical reflective layer 212 before and after the irreversible treatment by observation with the naked eye.

In the ink cartridge 200 having the label unit 210A of the modification example, only the pattern image P1 is formed before the irreversible treatment by the heating unit 100, but the pattern P1 with which the new black pattern image P2 is overlapped is formed after the treatment. As a result, according to the ink cartridge 200 having the label unit 210A of the modification example, it is possible to more significantly recognize the change of the irreversible increase and coloring of the absorptivity of the optical reflective layer 212 by the change in shape of the pattern image P1.

In the label unit 210A described above, the optical absorptive pattern layer 214 is formed to be overlapped with the optical functional layer 213, but the optical absorptive pattern layer 214 may be formed on the rear face side of the optical functional layer 213, that is, between the optical reflective layer 212 and the optical absorptive pattern layer 214. In this case, the optical functional layer 213 is formed to coat the optical absorptive pattern layer 214.

Figure 13:
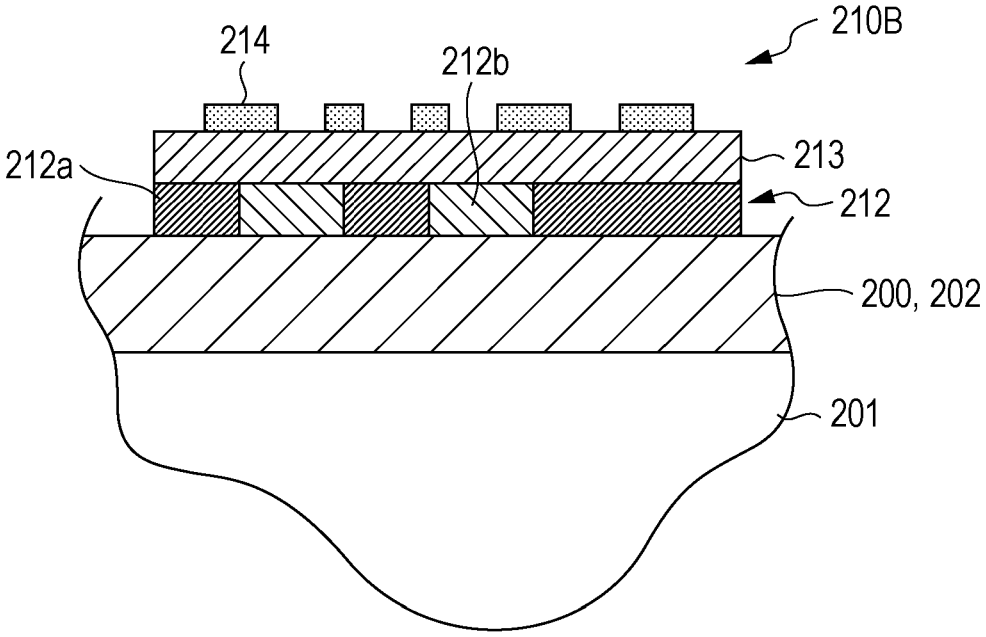
FIG. 13 is a cross-sectional view illustrating a label portion of another modification example, corresponding to FIG. 9.
Figure 14:
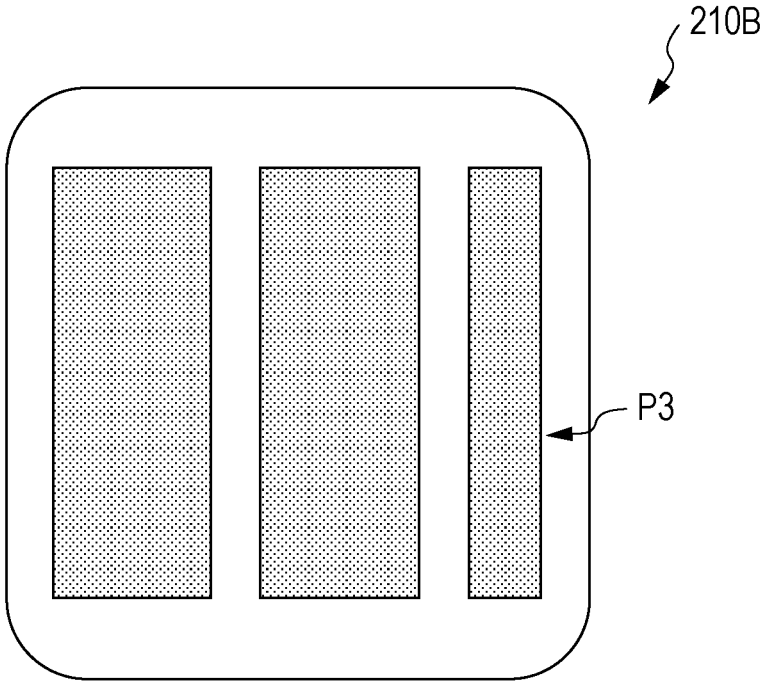
FIG. 14 is a diagram illustrating a reading image formed by reading the label portion in the reading unit, corresponding to FIG. 10.

FIG. 13 corresponds to FIG. 9, and is a cross-sectional view illustrating a label unit 210B of another modification example, and FIG. 14 corresponds to FIG. 10, and is a diagram illustrating a reading image formed by reading the label unit 210B in the reading unit 150.

As shown in FIG. 13 and FIG. 14, the label unit 210B of the modification example has the same layer structure as that of the label unit 210A described above, but the optical reflective layer 212 is partially heated in advance and a non-heat reception portion 212*a* and a heat reception portion 212*b* are provided in the optical reflective layer 212. In the state where the label unit 210*b* is formed on the ink cartridge 200 accommodating the predetermined full amount of ink, the label unit 210B is irradiated with the first wavelength of light by the irradiation unit 152 of the reading unit 150 as shown in FIG. 6, and the reflection light thereof is read by the light receiving unit 154. The reading result of the light receiving unit 154 at that time is a reading result corresponding to a pattern image P3 in which the area corresponding to the heat reception portion 212*b* of the optical reflective layer 212 is also black and the area corresponding to the other part of the label unit 210B is white, in addition to the formed pattern (the pattern image P1 shown in FIG. 10) of the optical absorptive pattern layer 214. The main control unit 40 receiving the reading result recognizes the pattern image P3 as an image. Therefore, according to the ink cartridge 200 having the label unit 210B, the pattern image P3 different from the image displayed by the label unit 210B is displayed when it is observed in detail with the naked eye. Accordingly, for example, it is possible to use the image displayed by the label unit 210B when it is observed with the naked eye, as dummy information. In this case, when the irreversible treatment by the heating unit 100 is performed, the non-heat reception unit 212*a* causes the irreversible increase and coloring of the absorptivity in the heat reception range, the reading result of the light receiving unit 154 is as shown in FIG. 12, and the pattern image P3 is changed before and after the irreversible treatment.

In the example shown in FIG. 13, the heat reception portion 212*b* and the optical absorptive pattern layer 214 are disposed such that an orthogonal projection of the heat reception portion 212*b* on the surface of the case 202 and an orthogonal projection of the pattern of the optical absorptive pattern layer 214 on the cartridge surface are positioned in the same area. That is, in the example shown in FIG. 13, a combination of at least a part of the pattern of the optical absorptive pattern layer 214 and at least a part of the heat reception portion 212*b* displays one kind of information. In this case, in the range of the heat reception portion 212*b* shown in FIG. 13, the heat reception can be performed in advance at the irreversible temperature described above before the ink cartridge 200 having the label unit 210B is mounted on the carriage 30, for example, at the factory shipment time.

The heat reception portion 212*b* and the optical absorptive pattern layer 214 may be disposed such that the orthogonal projection of the heat reception portion 212*b* on the surface of the case 202 and the orthogonal projection of the optical absorptive pattern layer 214 on the cartridge surface are positioned at different areas. That is, at least a part of the optical absorptive pattern layer 214 and at least a part of the heat reception portion 212*b* may display different kinds of information independent from each other.

Figure 15:
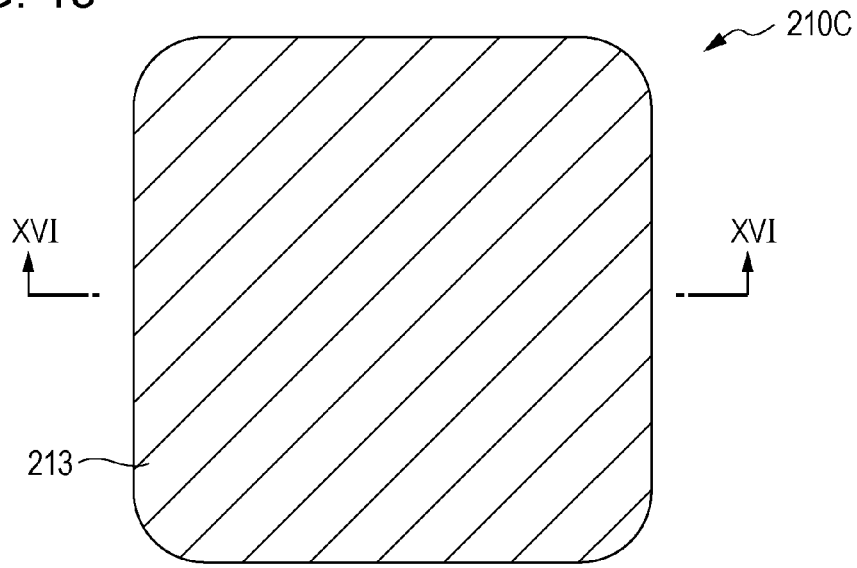
FIG. 15 is a front view illustrating a label portion according to another modification example.
Figure 16:
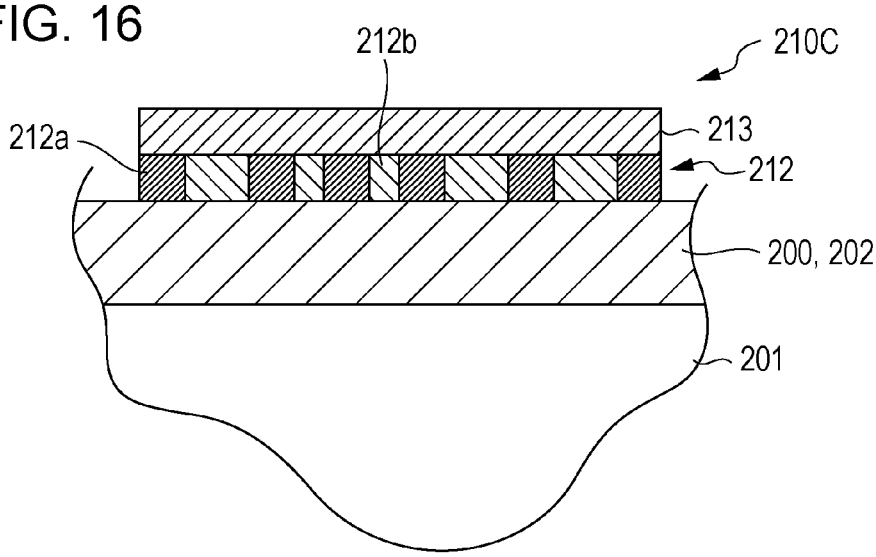
FIG. 16 is a cross-sectional view of XVI-XVI of FIG. 15.

FIG. 15 is a front view of a label unit 210C of another modification example, and FIG. 16 is a cross-sectional view of XVI-XVI of FIG. 15.

As shown in FIG. 15 and FIG. 16, in the label unit 210C of the modification example, the optical reflective layer 212 and the optical functional layer 213 are laminated from the surface face side on the surface of the case 202 of the ink cartridge 200, and then a part of the optical reflective layer 212 is the heat reception portion 212*b*. The heat reception portion 212*b* occupies the 1-dimensional code pattern as shown in FIG. 8, the 2-dimensional code pattern, or the other pattern such as a character, a symbol, a shape, and a figure. The heat reception portion 212*b* is formed in advance before the ink cartridge 200 having the label unit 210C is mounted on the carriage 30, for example, at the factory shipment time. That is, before shipment, the label unit 210C is subjected to the heat reception at the irreversible change temperature described above while driving the thermal head 102 to cover the pattern, the change in the irreversible absorptivity occurs in the heat reception range, and the heat reception portion 212*b* is formed similarly to the pattern. Even when the pattern formed by the heat reception portion 212*b* as described above is different according to the unique information in the ink cartridge 200, for example, the ink color, it is possible to specify the ink color accommodated in the cartridge from the reading result of the pattern at the time of mounting the cartridge.

When the label unit 210C is observed from the side of the optical functional layer 213 with the naked eye, the optical functional layer 213 displays the overall black image by the properties described above. At the time point of mounting the ink cartridge 200 on the carriage 30, when the label unit 210C of the ink cartridge 200 is read by the light receiving unit 154 while irradiating the label unit 210C with the first wavelength of light from the irradiation unit 152 of the reading unit 150 as shown in FIG. 6, the image of the reading result is an image in which the area corresponding to the pattern of the heat reception portion 212*b* causing the change in the irreversible absorptivity by the previous heat reception is black, and the area corresponding to the non-heat reception portion 212*a* is white. That is, in the ink cartridge 200 having the label unit 210C, the other image different from the image displayed by the label unit 210C when observing it with the naked eye is displayed.

To perform the irreversible treatment at the irreversible change timing on the label unit 210C, at least a part of the non-heat reception portion 212*a* is subjected to heat reception by the thermal head 102, and the range is changed by the heat reception portion 212*b*. As shown in FIG. 6, when the label unit 210C after the irreversible treatment is read by the light receiving unit 154 while irradiating it with the first wavelength of light from the irradiation unit 152 of the reading unit 150, the image of the reading result is an image in which the area that is newly the heat reception portion 212*b* by the irreversible treatment and the area corresponding to the area that is the non-heat reception portion 212*a*. The black area that is newly the heat reception portion 212*b* by the irreversible treatment is overlapped with the pattern of the heat reception portion 212*b* in the state where the irreversible treatment is completed in advance by the heat reception, and the image based on the reading result in the heat receiving unit 154 is different from that after the irreversible treatment. Therefore, also according to the ink cartridge 200 having the label unit 210C of the modification example, it is possible to obtain the effect described above.

Figure 17:
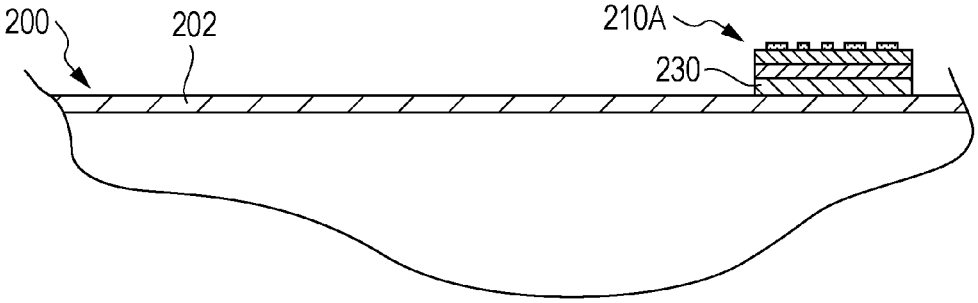
FIG. 17 is a diagram schematically illustrating another type of formation of a label portion.

FIG. 17 is a diagram schematically illustrating another aspect of formation of the label unit. In the aspect, an adhesive layer 230 is formed in the label unit 210A shown in FIG. 8 and FIG. 9, and the label unit 210A is adhered onto the surface of the case 202 by the adhesive layer 230. In the forming of the adhesive layer 230, for example, a printing base formed of, for example, paper, plastic, wood, glass, or resin is prepared, and the optical reflective layer 212 and the optical functional layer 213 are printed and formed on one face thereof in this order. The adhesive layer 230 is formed on the other face of the printing base by applying an adhesive, and the label unit 210C is adhered onto the surface of the case 202 through the adhesive layer 230. Even in such a manner, it is possible to obtain the effect described above. In this case, even when the label unit 210A subjected to the irreversible treatment by the heating unit 100 is peeled off from the ink cartridge 200 and is adhered to the other ink cartridge 200, and when the ink cartridge 200 is mounted on the carriage 30, the ink cartridge 200 can display the erroneous mounting of the ink cartridge which is used up on the display unit 72 of the operation unit 70 by the reading of the reading unit 150.

The embodiments of the invention have been described above, but the invention is not limited to the embodiments described above, and may be variously modified within a scope which does not deviate from the main concept thereof. For example, in the label unit 210B shown in FIG. 12, the optical absorptive pattern layer 214 may not be provided. The optical absorptive pattern layer 214 is not provided, and the heat reception portion 212*b* may be formed in advance with the pattern that is the pattern image P1.

The label unit 210, the label unit 210A, and the like may be covered with a projective layer in a thin film state or a thin tissue shape having transparency of allowing light of almost the entire wavelength band to pass.

In the embodiments, in the irreversible treatment performed on the label unit 210, the label unit 210A, and the like, the heating unit 100 having the thermal head 102 is used, but the optical reflective layer 212 may be heated using a metal heater, or the optical reflective layer 212 may be irradiated with laser light or microwaves to cause the optical reflective layer 212 to generate heat such that the absorptivity of the optical reflective layer 212 is irreversibly raised by receiving the heat.

What is claimed is:

1. A cartridge comprising:

an optical reflective layer that reflects light of a first wavelength; an optical functional layer, above the optical reflective layer, that allows light of the first wavelength to pass; and wherein an optical absorptance of the optical reflective layer is irreversibly raised by heat.

2. The cartridge according to claim 1, wherein the optical functional layer has a material absorbing light of the first wavelength.

3. The cartridge according to claim 1, wherein an optical absorptance of a first part of the optical reflective layer is raised by heat to be higher than a second part of the optical reflective layer.

4. The cartridge according to claim 3, wherein when light of the first wavelength is irradiated, a combination of a part of the material and the first part of the optical reflective layer displays predetermined information.

5. The cartridge according to claim 3, wherein when light of the first wavelength is irradiated, the part of the material and the first part of the optical reflective layer display different information.

6. The cartridge according to claim 1, wherein the first wavelength is a wavelength in an infrared area, and the optical functional layer is black.

7. The cartridge according to claim 6, wherein a transmittance of the optical functional layer to light of the first wavelength is equal to or higher than 30%, a difference of the transmittance of the optical functional layer between light of the first wavelength and light of a second wavelength is equal to or more than 10%, wherein the first wavelength is 700 to 800 nm, wherein the second wavelength is 800 to 1500 nm.

8. The cartridge according to claim 1, wherein the optical functional layer and the optical reflective layer are directly formed on a cartridge surface or are adhered onto the cartridge surface.

9. A printing apparatus which is provided with the cartridge according to claim 1, comprising:

a heating unit configured to heat the optical reflective layer.

10. A cartridge comprising:

an optical reflective layer that reflects light of a predetermined wavelength; an optical functional layer, above the optical reflective layer, that allows light of the predetermined wavelength to pass; wherein an optical absorptance of the optical reflective layer is irreversibly raised by heat; and wherein the optical functional layer is positioned on an incident side of the light.

* * * * *